United States Patent [19]

Berger et al.

[11] Patent Number: 4,644,675

[45] Date of Patent: Feb. 24, 1987

[54] PAGE TURNING DEVICE

[75] Inventors: John G. Berger; David J. Emmons, both of Roseville, Minn.

[73] Assignee: Regents of the University of Minnesota, Minneapolis, Minn.

[21] Appl. No.: 700,741

[22] Filed: Feb. 11, 1985

[51] Int. Cl.[4] ..... G09F 19/00

[52] U.S. Cl. ..... 40/531; 40/470; 40/475; 40/532; 84/487; 271/21

[58] Field of Search ..... 40/475, 476, 531, 532, 40/470; 271/21, 19, 22, 25, 37, 109, 111, 114, 120, 225; 101/72, 76; 369/266, 264, 263, 247, 270, 269, 268; 84/486, 487, 488, 489, 518

[56] References Cited

U.S. PATENT DOCUMENTS

| | | | |
|---|---|---|---|
| 868,903 | 10/1907 | Alrich | 84/518 |
| 1,741,465 | 12/1929 | Khaira | 369/270 |
| 1,846,097 | 2/1932 | Fritz | 40/531 |
| 2,176,483 | 10/1939 | Barron | 40/531 |
| 2,237,907 | 4/1941 | Landis | 310/93 |
| 2,353,763 | 7/1944 | Rodman | 369/269 |
| 2,411,084 | 11/1946 | Demers | 40/532 |
| 2,526,540 | 10/1950 | Carpenter | 84/487 |
| 2,601,047 | 6/1952 | Merrion | 40/531 |
| 2,755,580 | 7/1956 | Justice | 40/531 |
| 2,791,847 | 5/1957 | Hagman | 40/531 |
| 2,791,849 | 5/1957 | Brenneke | 40/531 |
| 2,885,806 | 5/1959 | Storm, Jr. et al. | 40/531 |
| 3,087,268 | 4/1963 | Rice | 40/531 |
| 3,174,242 | 3/1965 | Degorski et al. | 40/531 |
| 3,800,453 | 4/1974 | Kroes | 40/531 |
| 4,031,644 | 6/1977 | Rogers | 40/470 |
| 4,121,361 | 10/1978 | D'Arcy | 40/470 |
| 4,432,154 | 2/1984 | D'Arcy | 40/470 |
| 4,488,367 | 12/1984 | Yamauchi et al. | 40/531 |
| 4,553,467 | 11/1985 | Goldner | 84/487 |

FOREIGN PATENT DOCUMENTS

| | | | |
|---|---|---|---|
| 685324 | 1/1967 | Belgium | 40/531 |
| 2452383 | 11/1980 | France | 40/531 |
| 2482009 | 11/1981 | France | 40/532 |

OTHER PUBLICATIONS

A. Nishiyama, Page Turner, IBM Technical Disclosure, Feb. 1976, vol. 18, #9, pp. 2923–2924.

*Primary Examiner*—Gene Mancene
*Assistant Examiner*—James Hakomaki
*Attorney, Agent, or Firm*—Kinney & Lange

[57] ABSTRACT

A page turner device for an open book comprises a support for the book, and a power driven disc configured to rest on the top of the pages of such open book. When the power drive is energized, the disc will start to rotate while in contact with the open pages. The disc has a finger portion which protrudes outwardly from adjacent portions of the disc, and a page curler drive is used for creating a curl or arch in the center portions of an open page, so that when the finger rotates to the proper position, it will go into the recess under the curl, and as it continues to rotate, the finger will pull the page with it. When the disc comes to a rest position, the finger will have completely opened the subsequent page. At the rest position a cam operates a switch to disable the power drive until such time as the person reading again initiates a manual switch to commence the page turning sequence.

13 Claims, 6 Drawing Figures

PAGE TURNING DEVICE

BACKGROUND OF THE INVENTION

1. Field of the Invention.

The present invention relates to a page turning apparatus for mechanically turning pages of a book.

2. Description of the Prior Art.

Various mechanical page turning devices have been advanced in the prior art. For example, U.S. Pat. No. 2,775,580 issued July 24, 1956 to E. V. Justice, illustrates a page turning device that has a linear movable arm that forms a "curl" or arch in the page that is to be turned, and a rotating arm rotates above the level of the book pages so that it comes underneath the curl or arch, to turn the page, and then the arm comes to a stop over the newly opened pages in its stopped position. One of the disadvantages of this particular device is that during a substantial portion of rotation, the pages are left without any holding member tending to keep the previously turned pages open, which can give problems with the page going back to its original position.

U.S. Pat. No. 4,121,361 issued Oct. 24, 1978 to D'Arcy shows an automatic page turner that has a drive from a single gear motor. It has a member that forms a curl in a page to be turned, and there are hold-down members to helf form the curl in the page. A pair of flipper members are used, which rotate with the gear motor, and turn the page. The device includes page hold-down members so that the book can be held upside down for reading, if desired, and the motions involve fairly complex movements with a number of moving elements that may cause problems in page turning.

U.S. Pat. No. 2,791,849, patented May 14, 1957 by Brenneke, shows the use of suction to lift a page to be turned, and then a single rotating arm turns that page.

U.S. Pat. No. 3,174,242, patented Mar. 23, 1965 by Degorski et al, shows a page turner assembly wherein the pages have to be interleafed with coils of a spring, and then a rotating arm will systematically turn the pages in sequence. However, interleafing the spring and pages restricts the practical application of the device to something that has very few pages. While the spring will turn and spiral down into other pages as it rotates, it would appear that it would cause some problems in the individual separating of pages unless great care was taken.

U.S. Pat. No. 2,885,806, patented May 12, 1959 by Storm, Jr. et al, shows an adjustable page turner that has a rotating member with a number of radially extending arms. This device has quite a large hoop-type arrangement, and takes up substantial space. The motions are fairly complex as well, and while it depends only a rotary motion, and does have means resting on the pages to retain them in open position, it depends upon a fricton created movement of a page to insure that the page is lifted and turned, and depends upon the movement of a single arm for turning the page. The friction device depends on a sticky surface such as masking tape for the turning operation. In the specification, it indicates that the tape has to be changed as the tape becomes glazed, and has means for doing so. For incapacitated people, this can be a difficult task.

U.S. Pat. No. 4,031,644, patented June 28, 1977 to Rogers, shows a motion that uses a frictional wheel that will turn the pages, but which not only rotates but also translates, that is, moves from side to side. The motions are fairly involved in order to obtain the page turning action.

U.S. Pat. No. 868,903, issued Oct. 22, 1907 to Alrich, provides a book or music leaf turner, has a large number of moving parts, and uses rack and pinion gears for operation upon movement of a lever. The device shows that a foot pedal is alternately used for actuating the unit.

The patent does not show a device for forming a curl and a rotating member that will turn the page as it continues to operate.

SUMMARY OF THE INVENTION

The present invention relates to a page turner which is compact in size, and very reliable in operation. The device uses a disc which rests under gravity force, against both pages of an open book supported on a platform, and the disc remains in contact with the opened pages as it is rotated through a 360° cycle of movement.

After initiation of disc rotation under poewr, a friction wheel is used for forming a curl or arch in the page to be turned, and as the disc rotates a throat portion on the disc moves by the curl. The throat portion is formed where the periphery of the disc moves inwardly toward its axis. A page turning finger is formed trailing the throat. The finger protrudes outwardly beyond the normal periphery of the disc, and in connection with the throat, a sufficiently prominent finger is formed to insure that the finger will be inserted under the curl or arch formed in the page to be turned and as the disc continues to rotate, bring the page over the binding junction for turning.

The means for forming the curl or arch in the page comprises, in the form shown, a rotating friction wheel driven with a small electric motor through a one way clutch. The arch is formed by merely pushing the page edge portion toward the binding, to tend to curl the page with sufficient height so that as the disc does rotate, the finger will easily go under the arch to cause the turning. The motor for the friction drive wheel can be disabled by a timing cam mechanism which is used for ultimately stopping the disc when the full page turning motion has occurred.

Other forms of page curling devices can be used, such as a friction pad that moves in a linear motion from the edge of the page to be turned toward the binding to curl up the page in a central area of the page.

The page turning disc is made of a very low friction material, such as tetrafluoroethylene (Teflon) so that fractional forces between it and the book page are not a problem.

The device is relatively simple and works well in connection with books, in particular, as well as other bound works. The disc remains in contact with the binding area where the adjacent pages are joined together, during rest, and also throughout most of the movement of the page turning operation. This insures that the previously turned page will not tend to move back to its original position, and provides positive control for the page turning operation with relative simple mechanisms.

DETAILED DESCRIPTION OF THE PREFERRED EMBODIMENTS

Figures 1, 2, 3, 4, 5, 6:
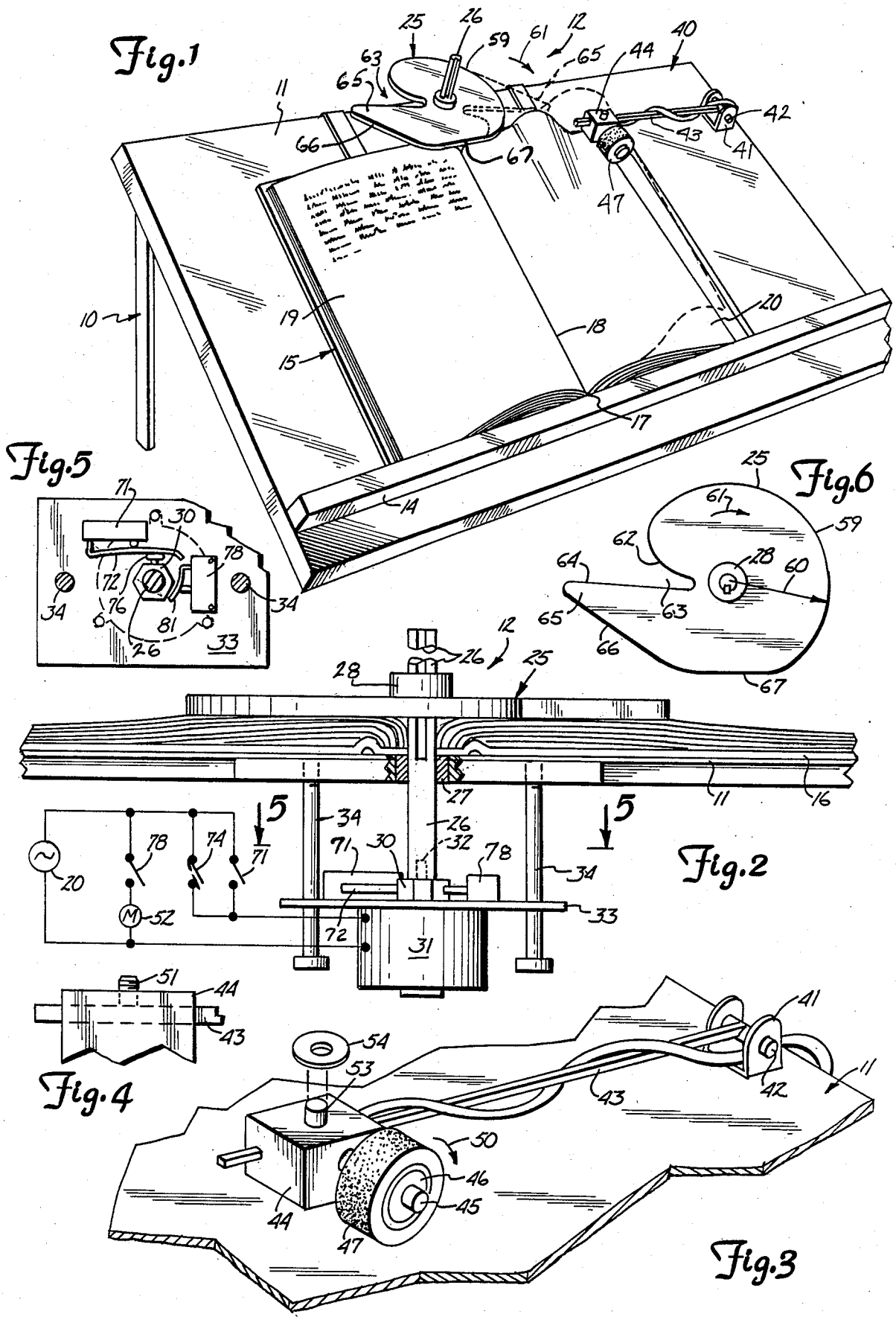
FIG. 1 is a perspective view of a platform support having a page turner apparatus installed thereon for turning the pages of an opened book.
FIG. 2 is a rear view of FIG. 1 with a part schematic representation of a control circuit therewith.
FIG. 3 is a perspective view of a mechanism for forming a curl in a page to be turned.
FIG. 4 is a top plan view of a portion of a housing for motor shown in FIG. 3.
FIG. 5 is a sectional view taken as along line 5—5 in FIG. 2.
FIG. 6 is a top plan view of a typical page turning disc used with the present invention.

Referring to FIG. 1, a book support 10 has a upper book support platform 11 thereon, which forms part of the page turning mechanism shown generally at 12. The support 10 has an adjustable book support cross piece 14 which supports the lower edge of a book illustrated generally at 15. The book 15 is positioned on the platform 11. As shown, the platform 11 has an upper surface that is inclined and against which the book covers 16 (see FIG. 2) will rest. The platform can take any desired configuration, and the book is made up of a plurality of pages having a binding in the center shown generally at 17, where the adjacent pages are joined together to form an open page central line shown at 18.

As shown, the surface shown at 19 is the surface of a previously turned page, within the nomenclature of this application, and a page to be turned is shown at 20. The binding and central line 18 are in the center of the opened book. The page turning apparatus 12 includes a master page turning disc indicated generally at 25 which is mounted on a shaft 26 that is rotatably mounted through a suitable bearing 27 on platform 11. The bearing 27 permits the shaft to rotate the disc 25 and also slide axially. The disc 25, as shown in FIG. 6, has a central drive hub 28 that is of a suitable configuration so that it can be driven by the shaft 26. The hub 28 is adjustable on the shaft 26 and is held from sliding on the shaft in any suitable manner, such as with a set screw in hub 28.

The shaft 26 in turn has a cam member 30 on the lower end thereof. It should be noted that the shaft 26 extends through the platform 11 and cam member 30 is below the platform.

As shown, the shaft 26 is driven with a motor 31 which has its drive shaft shown in dotted lines at 32 mounted in a bore in the shaft 26 and drivably held in position, so that the cam member 30 is spaced from the end of the motor 31. The motor 31, in turn, is attached to a guide plate 33 which is slidably mounted on suitable guide studs 34 that, in turn, are fixed to the base 11 in a suitable manner. For example, the guide studs 34 can be long cap screws having heads thereon and having their opposite ends threaded into tapped holes in the bottom of the platform 11.

Cam member 30 is maintained at a position spaced slightly from the plate 33, or if desired a suitable low friction pad can be placed between the cam member 30 and the upper surface of the plate. The cam member 30 must rotate with the motor shaft 32, while the plate 33 stays stationary, so there is relative motion between the two parts.

In addition to the rotating disc 25, which will be more fully described, the apparatus includes a page "curl" or "arch" forming device shown generally at 40. This curl or arch forming device is a unit which acts on page 20 to be turned. The unit includes an actuator that tends to push the outer edge of the page in toward the junction line 18 of the binding. When this is done, the page 20 will tend to curl or arch upwardly in its center portion generally as shown in FIG. 1.

The curl forming device comprises a support 41 that is fixed to the platform 11, and a pivot pin 42 is mounted in the support 41. The pivot pin 42, in turn, mounts an arm 43 that extends in direction toward the center line 18 of the book. A housing 44 is adjustably slidably mounted along the arm 43, and as shown, the housing 44 has a small electric motor reduction and gear set mounted on the interior thereof, having an output shaft 45. The output shaft 45, in turn, mounts a one way bearing or clutch 46 of conventional design and an outer friction wheel 47 is mounted on the outer race of this clutch or bearing 46. The wheel is driven when the shaft 45 is rotated in the direction indicated by the arrow 50, but will free wheel or over run the drive shaft to permit the wheel 47 to move in that same rotational direction at a rate faster than the shaft 45 is turning. The support housing 44 is adjustable along the length of the arm 43 and is held with a set screw 51 as shown in FIG. 4.

The motor indicated at 52 in the electric schematic included with FIG. 2 can be any small conventional electric motor driving through a suitable gear reducer. The housing 44, in turn, has a weight retainer stud 53 on the upper surface thereof, and weights such as small washers shown at 54 can be applied to this stud to add weight to the curl forming assembly to tend to urge the wheel 47 against the page with greater force. The amount of force can be controleld, so that the friction between the wheel 47 and the upper surface of the page being turned can be maintained even with relatively large pages.

In operation, the disc 25 is placed so that it overlaps the upper edges of the open pages generally as shown in the dotted line in FIG. 6, and as can be seen, the disc 25 has a part circular cross section peripheral edge 59 at a radius indicated generally at 60. The edge 59 extends for at least 180° around the disc. Thus, if the disc 25 rotates in direction as indicated by the arrow 61, the peripheral edge 59 of the disc 25, which forms the part circular configuration will continue to overlap the upper edge of the book and hold the pages open.

The peripheral edge of the disc, however, cuts sharply back in toward the axis or center of rotation of the disc along a line shown at 62, to form a throat or recess 63. The trailing edge of recess 63 is formed by a radial edge 64 forming a leading edge of a finger 65, which is the page turning finger. This finger extends outwardly farther from the axis of the disc than the edge 59 defined by the radius 60, so that the finger protrudes outside the part circular edge a desired amount to insure that it will fit underneath the page sufficiently to provide a lifting force. The end of the finger 65 is rounded, and, of course, the lead in along the edge 62 from the circular periphery is also rounded. The finger 65 then is bounded by a peripheral line 66 that extends inwardly to define an angle in relation to the radial edge 64 of about 30°. This is a negative rake to relieve the back side of the finger 65 so that as the page is turned, there is no protrusion at the back side that causes dragging. This peripheral edge 66 then intersects a chordal edge 67 which intersects the edge 59 forming the part circular cross section peripheral edge. The chordal edge 67 is relatively short and is at a substantial radius (almost the radius 60) so that the stopped position the disc overlies the book pages and the edge is perpendicular to the separating line 18 between the pages as shown in FIG. 1.

The control for the motor 31 also interlocks with the control for the motor 52 that rotates the curl forming wheel 47 through the one-way clutch or bearing 46. Schematically, the arrangement is shown in connection with FIG. 2. A power source indicated at 70, is coupled through parallel switches to power the motor 31. A first normally closed microswitch 71 (it is shown in open position) is used to normally power the motor except when cam 30 is operating the microswitch 71 (shown in FIG. 5) through the use of an actuator lug 76 on cam 30, which actuates an actuator finger 72 to disable the switch 71 and shut off the motor 31. The parallel switch indicated at 74 is a foot operated switch for the operator, so that when the cam and disc are in position as shown in FIG. 5, and also in FIGS. 1 and 2, the motor 31 will not run until the foot operated switch 74 is actuated, at which time the circuit is completed from the power source to the motor 31 to drive it. The foot switch 74 has to be held down sufficiently long so that the actuator lug 76 moves away from the finger 72. Once this cam actuator lug 76 rotates beyond the actuator finger 72, switch 71 will close, in that it is a normally closed switch, and the motor 31 will continue to run until the cam actuator lug again disables the switch 71, if the foot operated switch 74 is released to open in the meantime.

The motor 52 is controlled with a microswitch 78, which is also mounted onto the sliding guide plate 33 as shown in FIG. 5. Microswitch 78 is closed by the cam actuator lug 76 as the shaft 26 is rotated by the motor 31 through the use of a switch actuator finger 81. The actuator finger 81 can be of length and of configuration so that the switch 78 will be held closed for a desired length of time to insure that the wheel 47 will form an adequate curl in the page 20. After that, the motor 52 can be turned off. The motor drives through a gear train which will not permit reverse movement from the force of the curl tending to straighten out. The wheel drive clutch or bearing will hold the wheel 47 and the formed page curl in position until the finger 65 comes under the curl as the motor 31 continues to run and the disc 25 continues to rotate. When the finger 65 engages the underside of the curl, and tends to turn the page 20, the finger will pull the page around and the one way bearing or clutch 46 will permit the wheel 47 to rotate in direction to let the page be pulled easily out from under the wheel.

Then, once the motor 31 has rotated the disc 25 to the position shown in FIG. 1, it can be seen in FIG. 5 that the cam actuator lug 76 will have engaged the actuator finger 72 to disable switch 71, and thereby stop the motor 31.

The page turner then will remain at rest until the foot switch 74 is again depressed. The page turner automatically operates once the foot switch 74 has been held a sufficiently long time to permit the cam actuator lug 76 to rotate to clear finger 72 and let the switch 71 move to its normally closed position. The drive and curl forming sequence will repeat until the page has been turned, and the disc 25 is holding the pages open.

The throat portion and finger are arranged so that at least some portion of the disc remains in contact with the book pages all during the revolution of the disc. The part circular cross section defined by edge 59 extends onto the pages until the finger has moved under the curl formed in page 20. As the finger turns the page, it rest on the pages under the weight of motor 31 and continues to hold the pages open until it moves off the turned page, at which time the portion of the disc adjacent edge 67 is resting on the pages.

Also, the throat or recess 63, as shown in dotted lines in FIG. 1 permits the curl to move toward line 18 so the curl is in position where finger 65 can move under the page easily.

It can be seen that the arrangement here wil be suitable for holding books even which are positioned generally vertically, or at an inclined position between horizontal and vertical. Usually a slight angle such as that shown in FIG. 1, is the most satisfactory, and will be adequate for reading for many people that are propped up in bed, or sitting a chair.

Although the present invention has been described with reference to preferred embodiments, workers skilled in the art will recognize that changes may be made in form and detail without departing from the spirit and scope of the invention.

What is claimed is:

1. In a page turning apparatus comprising a support for a bound volume in which the pages are to be turned, said support holding the bound volume in an open position, the pages facing in a direction toward a viewer, and being bound together at a binding at edges of the pages which binding is substantially in the center of said opened pages, the improvement comprising:

a shaft rotatably mounted on said support about an axis generally perpendicular to the plane of the pages in their open position, said shaft also being slidably mounted on the support for movement along said axis;

a generally planar disc fixedly mounted on said shaft, and overlying edge portions of adjacent open pages, adjacent one end of pages with which the disc is used only, and adjacent the location where the pages are bound together;

power means coupled directly to said shaft to rotate said shaft and disc at selected intervals, said power means providing a biasing force on said shaft urging the disc toward the pages with which the disc is used;

means laterally of said disc for engaging a page to be turned for forming a curl in such page to raise a center portion of such page above the level of underlying pages;

said disc having a periphery which is irregularly shaped, a first portion thereof being of size to rest on the end edge portion only of the opened pages, and a second portion thereof forming a recessed throat to define a finger portion that extends outwardly from said recessed throat, so that as said disc rotates said finger can move under the formed curl and as said finger rotates, pull the page in which a curl has been formed across the junction between the bound pages and turn the page in which the curl has been formed to expose the opposite side of such page, said finger moving clear of the opened pages as the disc continues to rotate; and means to disable said power means to stop said disc after one revolution with the finger in a rest position away from the pages and with portions of the disc continuing to overlie end portions only of the opened pages.

2. The apparatus as specified in claim 1 wherein said disc rests on the open pages for a substantial portion of its rotation, and the periphery of the disc where the throat is formed, clearing the page to be turned as the finger approaches the edge of the page to be turned and moves under the formed curl.

3. The apparatus as specified in claim 1 wherein the means for forming a curl in the page to be turned comprises a rotary drive wheel riding on an upwardly facing surface of a page to be turned.

4. The apparatus as specified in claim 1 wherein said means for forming a curl in the page to be turned comprises drive wheel means movable in a direction to pull an outer edge of the page toward the binding of the adjacent pages to form the curl between the means for forming and the binding.

5. The apparatus as specified in claim 1 wherein said means for forming a curl comprises a rotary wheel, one way clutch means for driving said rotary wheel from a motor, said one way clutch means permitting a page to be pulled out from under said wheel and rotate said wheel without moving the motor when the page is moved toward the binding.

6. The apparatus as specified in claim 1 wherein said power means for driving said disc comprises a motor having an output shaft fixedly mounted on the first mentioned shaft and slidably nonrotatably mounted to the support for movement in direction along the axis of the first mentioned shaft below the support, said motor forming a weight tending to urge said disc toward the support.

7. The apparatus as specified in claim 1 wherein said disc periphery is configured so that at least a portion of the disc is in contact with a book properly positioned on said support throughout the entire revolution of said disc and at rest position the edge of the disc engaging the book forms a chordal line substantially perpendicular to the binding line of a book on the support, and terminating the disc at a radius less than that of the majority of the disc periphery.

8. A page turning device for a book or the like comprising:

a book support platform;

means to position a book on said support platform in a desired location;

a shaft member projecting through said support platform and having a portion extending above the support platform, said shaft member being slidably mounted relative to the support platform for movement along its axis;

a generally planar disc member fixedly mounted on said shaft above said support platform;

a drive motor having a shaft drivably mounted on said shaft below said support platform, the weight of the drive motor tending to urge the shaft downwardly so that the disc above said support platform tends to move toward a book supported on the platform;

means coupled between the support platform and motor to restrain the motor from rotating as it drives the shaft and to permit the motor and the shaft to slide in direction along the shaft axis;

means mounted relative to the support platform for arching the center portion of a page to be turned upwardly above remaining pages to form a curl;

said disc having a peripheral portion engaging the open pages along a juncture between the pages of the book in an initial disc position and tending to hold the pages open with the weight of the motor; and said curl on the page to be turned being formed between the outer edge of the page and the disc, said disc peripheral edge having a portion which forms a throat so that the peripheral edge moves inwardly toward the axis of the disc in a first disc sector, and the periphery of the disc then extends abruptly from the minimum radius of the throat substantially radially outwardly to a finger end, the radially extending portion of the edge forming a rotationally leading portion of the finger, the trailing edge of the finger tapering at a desired angle relative to the radial line, the curl of the page to be turned being high enough so that as the throat portion moves adjacent the curl, the finger will enter below the curl and will pull the page to turn it as the disc continues to rotate a full 360°.

9. The apparatus as specified in claim 8 wherein said disc has a circular periphery for substantially 180° thereof, the circular periphery of the disc resting on surfaces of an open page throughout its first 180° of rotation while the curl is formed in the page to be turned.

10. The apparatus of claim 9 wherein the finger portion extends protruding outwardly beyond the part-circular edge.

11. The apparatus of claim 10 wherein the angle between the trailing edge of said finger and the radial line is in the range of 30°.

12. The apparatus of claim 9 wherein the disc is formed from a low friction material having the properties of tetrafluoroethylene.

13. The apparatus of claim 9 wherein the disc has an edge formed as a chordal line with respect to the axis the part circular periphery and of smaller radius than the part circular periphery, the portion of the disc having the chordal edge overlying open pages of the book on the support in the initial disc position so that a greater portion of the open pages are left exposed than when the part circular portion overlies such pages.

* * * * *